United States Patent [19]

Shoemaker

[11] 4,363,421

[45] Dec. 14, 1982

[54] SECURITY SEAL FOR CONTAINERS

[75] Inventor: Richard G. Shoemaker, Noank, Conn.

[73] Assignee: Pfizer Inc., New York, N.Y.

[21] Appl. No.: 269,927

[22] Filed: Jun. 2, 1981

[51] Int. Cl.[3] ..... B65D 45/32

[52] U.S. Cl. ..... 220/319; 215/273; 215/246; 220/214

[58] Field of Search ..... 215/273, 246, 232; 220/319, 320, 321, 359, 214; 229/5.6, 5.7

[56] References Cited

U.S. PATENT DOCUMENTS 3,897,884 8/1975 Lankenau ..... 220/320

4,232,797 11/1980 Waterbury ..... 220/359

*Primary Examiner*—George T. Hall

*Attorney, Agent, or Firm*—Charles J. Knuth; Peter C. Richardson; Edward B. Cantey, Jr.

[57] ABSTRACT

A security seal is described which can be used to protect the closure device of a container so that a subsequent opening of the container will be evident. The seal comprises a strip of resilient plastic film with patches of a tamper-resistant adhesive at each end, leaving an adhesive-free gap in between. The seal is applied so that the adhesive patches adhere to the container to keep the adhesive-free section flexed closely over and spanning the closure device. Thus, when cut to release the closure part, the strip flexes outward to produce easily noticed loose ends.

5 Claims, 4 Drawing Figures

SECURITY SEAL FOR CONTAINERS

BACKGROUND OF THE INVENTION

This invention relates to the sealing of containers so that a subsequent opening can be easily detected. It relates especially to the resealing of containers already opened so that a second opening can be easily noticed.

The term security seal is used in this application to mean an article that protects the closure of a container so that any subsequent normal opening of the container is made obvious.

There are a number of security seals in common use that work in a variety of ways to make it evident when a container has been opened. As examples, there are: for bottles, spun aluminum screw caps, where a perforated section is broken on unscrewing; for jars, plastic shrink-wrap bands to be cut to release the top; for fiber and metal drums, lead-sealed wires which are clipped to release the locking mechanism. While these known seals are generally satisfactory, they require special equipment to apply and they do not lend themselves well to the resealing of already opened containers.

The need to reseal containers frequently arises, e.g. to protect the contents between time of sampling by Quality Control and time of release for use. Consequently, there is a need for a security seal that is easily applied, requires no special equipment to put on or to take off, and is of low cost. The object of this invention is to provide such a seal, especially one useful for resealing opened containers.

SUMMARY OF THE INVENTION

A security seal according to this invention is affixed across a container closure device closely enough that the closure cannot be operated to open the container unless the seal is cut or broken.

The seal comprises a strip of resilient plastic film coated on its inner surface with tamper-resistant adhesive, but with a gap in the coating intermediate the ends. This adhesive-free gap is long enough to span the closure device to be protected. In use, the seal is placed so that the adhesive holds the strip tightly to the container with the adhesive-free gap on the strip convexly flexed closely over the closure device. Placed in this way, the closure cannot be operated without cutting or breaking the strip through the adhesive-free section.

When the strip is cut to release the closure device, the resiliency of the strip causes the newly created adhesive-free ends to flex outward away from the closure device into flag-like loose ends. It is the creation of these easily noticed loose ends that give security properties to the seal.

It is an important advantage of this new type security seal that it is suitable for use with a wide range of containers wherever the adhesive-free area of the film can closely span the closure part in convexly flexed condition. Other advantages are ease of application without tools, and low cost.

BRIEF DESCRIPTION OF THE DRAWINGS

The invention will be disclosed with the aid of drawings, of which.

DETAILED DESCRIPTION OF THE INVENTION

Figure 2:
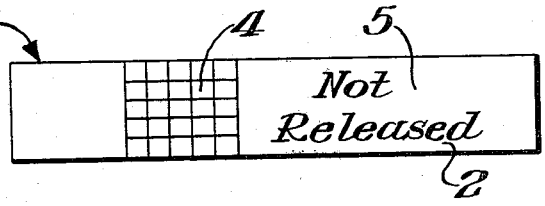
FIG. 2 is a plan view of the outer surface of said embodiment.
Figure 1:
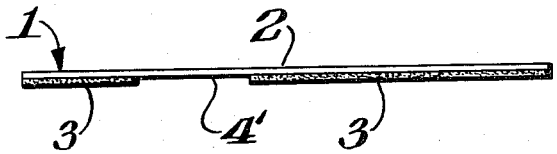
FIG. 1 is a side elevation view of an embodiment of the invention.

The general form of the invention is illustrated by FIGS. 1 and 2. FIG. 1 is a side elevation view of a security seal according to this invention, but with the vertical scale exaggerated to show detail. The body of the seal 1 is a thin rectangular strip 2 of resilient plastic film. The inner surface of strip 2 is coated with a tamper-resistant adhesive 3 at each end, leaving an adhesive-free section of the strip in between. This adhesive-free gap 4 in the coating is at least as long as the width of the container closure device to be protected. As shown in FIG. 2, the outer surface of the strip 2 at area 4' can be marked to show the location and extent of the adhesive-free gap 4 on the inner surface. The outer surface may have a distinctive pattern or legend 5 to indicate the purpose of sealing. This seal is applied by affixing the adhesive coated ends 3 to the container so that the adhesive-free gap 4 closely spans the closure device to be protected, and is under convex flexural tension. It is necessary for the seal to span the closure device closely enough so that the closure cannot be opened by moving aside or distorting the seal. Thus to open the closure, the seal must be cut or broken. It is important that the adhesive-free section of the strip be under convex flexural tension. Then, when cut, the resilience of the strip causes flag-like loose ends to flex outward away from the closure to become visible signs that the container may have been opened.

Suitable plastic films for the body strip for this security seal are those that have little stretch, are flexible, and are resilient enough to unbend promptly from a flexed position when cut. The polyester film sold by DuPont under the trade name Mylar is preferred.

The adhesive used is of the tamper-resistant type, i.e. one that adheres so tightly to the plastic film and to the container materials that the film can not be removed without noticeable damage. Suitable adhesives include the pressure sensitive adhesives AS 15-W and HA-4 sold by the Topflight Crop. With pressure sensitive adhesives, a removeable backing paper, not shown in the figures, may be employed if desired to protect the adhesive before use.

The size of a seal according to this invention, and the position and extent of the adhesive-free gap will vary with the size and type of closure to be protected.

Figure 3:
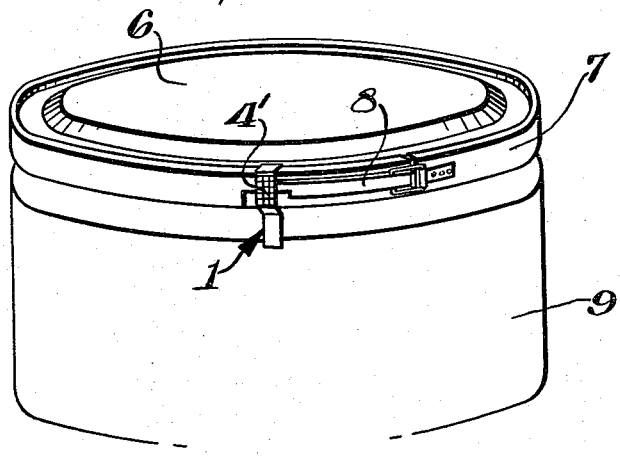
FIG. 3 is a perspective view of a seal securing the locking lever of a fiber drum.

A preferred embodiment is designed to seal the locking level of open-head fiber drums of the type sold under the trade name LEVERLOCK by the Continental Can Co. The body strip of this seal may be made from 0.002" thick Mylar film, about 3½" long by ⅜" wide. The first ¾" of the inner surface of a first end of the strip is coated with tamper-resistant adhesive, and the first 2" of the inner surface of the second end is similarly coated. Thus, a ¾" adhesive-free gap in the coating is left on the inner surface, starting ¾" from the first end. The other surface of the strip is marked to show the location and extent of adhesive-free surface underneath. FIG. 3 illustrates this application. The drum body is partly shown as 9, with drum cover 6 held in place by split ring 7. Split ring 7 is locked tight to secure the cover by locking lever 8. A security seal 1 is shown placed vertically over the free end of locking lever 8 with the short adhesive patch affixed over the split ring 7 and the long adhesive patch on the drum body 9. The adhesive patches hold the adhesive-free section of the strip, indicated by 4', convexly flexed closely over the locking lever. Thus placed, the seal 1 prevents the locking lever 8 from being actuated by pivoting out and loosening the split ring 7 so that the cover 6 can be removed. However, when the seal is cut through the adhesive-free section, not only is the locking lever released, but the newly created cut ends flex outward and assume an easily noticed flag-like posture signalling that the seal has been cut.

If the seal had been of conventional construction without the adhesive-free gap, releasing the lever by neat sharp cuts would make it possible to reclose the locking lever with the three pieces of seal still in perfect register. It would then be difficult to see that the seal had been cut and the drum possibly opened.

Figure 4:
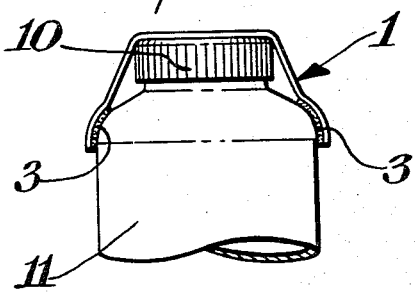
FIG. 4 shows in side elevation a seal securing a jar with a twist-off cap.

Another embodiment is shown on FIG. 4. In this case, a seal 1 according to this invention is convexly flexed closely over the twist-off cap 10 of a glass jar, partly shown as 11. The adhesive patches 3 of seal 1 are affixed to the jar 11 on either side of the cap 10 holding the adhesive-free section of the strip 2 flexed closely over the cap 10. In this position, the seal cannot be moved aside to free the cap. Here again, a cut or break to free the cap 10 will create flag-like loose ends easily seen as indicators that the seal has been tampered with, and is no longer intact.

It will be evident that security seal according to this invention can be made in many shapes and arrangements to adapt them to different types of container closure devices. Thus, the scope of this invention is not to be limited to the embodiments discussed.

I claim:

1. A security seal for a container closure device comprising a strip of resilient plastic film whose lengthwise dimension exceeds the width of said closure device, said strip having on the inner surface thereof a coating of tamper-resistant adhesive, said coating having an adhesive-free gap intermediate the ends thereof, the length of said gap being at least equal to the width of said closure device, whereby said strip may be adherently fixed to said container across said closure device with said adhesive-free gap held closely over said closure device and under convex flexural tension.

2. The seal of claim 1 wherein said closure device is the locking lever of a lever-locking type drum.

3. The seal of claim 1 having a distinctive pattern on the outer surface thereof, coextensive with said adhesive-free gap.

4. The seal of claim 1 wherein said adhesive is a pressure sensitive adhesive.

5. A method of sealing a container to render evident the subsequent opening thereof, said method comprising adherently affixing to said container and across the container closure device a strip of resilient plastic film, said strip having on the inner surface thereof a coating of tamper-resistant adhesive, said coating having an adhesive-free gap intermediate the ends thereof, the length of said gap being at least equal to the width of said closure device, said strip being affixed to said container so that said adhesive-free gap is held closely over said closure device and under convex flexural tension.

* * * * *